United States Patent [19]

Garrec

[11] Patent Number: 4,660,796

[45] Date of Patent: Apr. 28, 1987

[54] TURBO-MACHINE TRANSPORT FRAME

[75] Inventor: Jean Garrec, Evry, France

[73] Assignee: Societe Nationale d'Etude et de Construction de Moteurs D'Aviation "S.N.E.C.M.A.", Paris, France

[21] Appl. No.: 602,368

[22] Filed: Apr. 20, 1984

[30] Foreign Application Priority Data

Dec. 29, 1983 [FR] France ..... 83 20988

[51] Int. Cl.[4] ..... F16M 13/00

[52] U.S. Cl. ..... 248/544; 108/55.1; 248/671; 414/589

[58] Field of Search ..... 248/544, 676, 671, 638, 248/678, 554, 557; 206/318, 386, 509; 410/47, 49; 108/55.1; 414/462, 589

[56] References Cited

U.S. PATENT DOCUMENTS

| | | | |
|---|---|---|---|
| 1,838,754 | 12/1931 | Frame | 206/509 X |
| 1,912,847 | 6/1933 | Klepel | 206/509 X |
| 2,785,807 | 3/1957 | Prowinsky | 414/589 |
| 2,867,334 | 1/1959 | Aiken et al. | 414/589 |
| 2,885,165 | 5/1959 | Smolen | 248/671 |
| 2,956,763 | 10/1960 | D'Arca | 108/55.1 X |
| 3,814,489 | 6/1974 | Clark et al. | 206/509 X |
| 3,949,878 | 4/1976 | Tuthill | 206/386 X |
| 4,440,265 | 4/1984 | Spagnoli | 414/589 X |
| 4,447,186 | 5/1984 | Renfro et al. | 414/589 |
| 4,461,455 | 7/1984 | Mills | 414/590 X |

FOREIGN PATENT DOCUMENTS

| | | | |
|---|---|---|---|
| 2030480 | 1/1972 | Fed. Rep. of Germany | 108/55.1 |

*Primary Examiner*—J. Franklin Foss

*Attorney, Agent, or Firm*—Oblon, Fisher, Spivak, McClelland & Maier

[57] ABSTRACT

In order to facilitate the operations of handling and of transportation when empty between the works of an engine manufacturer and the works of an aircraft manufacturer, a transportation framework is provided with support members which are adjustable. These members, on which the turbo-machine rests, are mounted pivotally on the platform. It is possible to cause them to be adapted so as to take up two positions; a higher position where they support the turbo machine and, a lower position where they are folded on to the platform. The vertical height of the frameworks is thus reduced when empty and enables them to be stacked.

9 Claims, 4 Drawing Figures

TURBO-MACHINE TRANSPORT FRAME

BACKGROUND OF THE INVENTION

1. Field of the Invention

The invention relates to a turbo-machine transportation framework, for example for a turbo jet engine with high dilution (or by-pass) ratio.

2. Summary of the Prior Art

The use of a framework is necessary in order to support, for example, a turbo jet engine during its transportation over distances which may be substantial, from the works of engine manufacturers to those of the aircraft manufacturer or aircraft operator. Such a framework must be suitable to enable use both with road transport means, as well as aerial or maritime means without it being necessary to apply modifications to those means for adapting them to the material transported. One previously proposed framework has the form of a platform surmounted by arms extending vertically and provided at their extremities with attachment means cooperating with complementary means attached to the casing of the turbo-jet engine. In general the latter is held isostatically at three points, two points at the front, one point at the rear. Such frames are designed in order to satisfy handling conditions by persons who are not provided with the necessary qualifications. For this reason their design is simple and robust enabling ready practical application and avoiding any risk of harm to the material transported.

Once the engine arrives at its destination, and is taken over by the aircraft manufacturer or other end user, the frames are returned to the engine manufacturer in order to re-use them for the transportation of new or re-conditioned engines.

With the aim of reducing their bulk and limiting the costs of transport when empty, it is possible to arrange the frameworks in twos and dispose them, with one opposite to the other. It is apparent that this solution has not been satisfactory since the support members are subject to stresses for which they were not designed, and, various handling operations may be effected with less care than is necessary for material such as turbo jet engines, giving rise to damage requiring repair work on the frameworks before their re-use.

The object of the invention is thus to facilitate transportation of empty frameworks in order to reduce costs on the one hand, and to limit the risk of damage to the material on the other hand.

SUMMARY OF THE INVENTION

According to the present invention there is provided in a transportation framework for a turbo machine, a mobile platform, support members on which the turbo machine rests during transportation and handling operations and means for adjusting the location of the said support members with respect to the said platform so as to enable them to assume at least two locations, one being an active support location for the turbo machine and the other being an inactive location where the support members are folded onto the platform.

A first advantage of frameworks in accordance with the invention is the reduction in the vertical height facilitating handling operations and loading on to the transport means of the empty framework.

A second advantage of frameworks in accordance with the invention is that the stacking of several frameworks one on the other is possible; it is sufficient for this to provide means ensuring stable support of one framework on the other when the support members are folded. Such means can be constituted for example by mountings carried on the platforms of the lower frame, on which it rests and, to which is secured the platform of the upper frame. In this way the ends of the support members are not involved and risk of damage does not arise.

Finally frameworks in accordance with the invention offer the supplementary advantage of enabling transportation by air of the engine from the same framework when the latter is constituted by separable elements. In practice, in accordance with the required folding operations two framework constructions are known: a framework constituted by separable elements and a monobloc framework. In the first case the support members form a cradle in which the engine rests, this cradle is itself mounted on a base during the transportation of the engine. For air transportation operations the cradle is disposed with its engine on a trolley which is placed beneath the wing of the aircraft within the opening of the cowling, rigid with the pylon; the cradle is hoisted from the wing by means of a pulley system; once the engine is secured, the cradle is lowered onto the trolley and uncoupled. The low available height beneath an aircraft wing requires a trolley which is very low in order to be able to disengage the cradle. Owing to the arrangements in accordance with the invention, it is not necessary to transpose the cradle on a special trolley for aircraft engine transportation, it is sufficient to adapt rolling means on the base, in order to be able to place it around the aircraft. In order to disengage the cradle once the engine is installed, it is sufficient to fold the support members (the order of operations is clearly opposite for the mounting of the engine). In the case of a monobloc framework the elements constituting the cradle and the base are not separable. The function of such a framework is limited to transportation; it is, in practice, too heavy to enable it to be hoisted from the wing of the aircraft; the latter would not be able to support the load.

According to the conditions and the requirements of the users, two embodiments of framework are possible. The description which follows relates to one embodiment of a framework, which should not be considered to be limiting, and in which the members are separable. However it will be readily understood that one would not depart from the scope of the invention by applying the main characteristic, namely the stowing of the support members, with a monobloc frame.

DESCRIPTION OF THE PREFERRED EMBODIMENT

Figure 1:
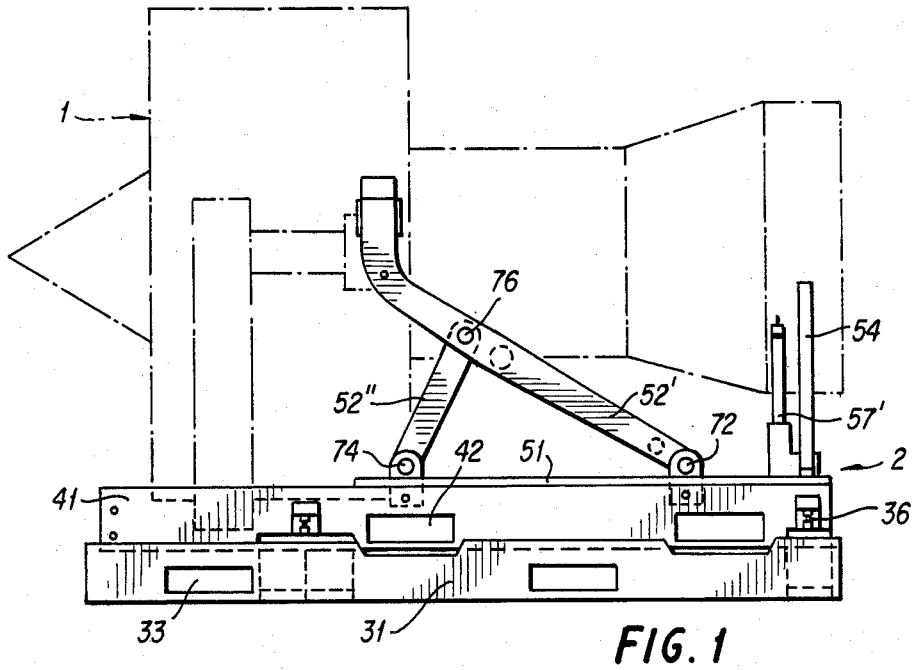
FIG. 1 is a side elevation of a framework in accordance with the invention supporting a turbo-jet engine with high dilution ratio indicated by chain lines.

When referring to the first three Figures it will be apparent from the chain lines, that a turbo jet engine 1 having a high ratio of dilution or by-pass ratio is diagrammatically represented, when installed on a framework 2, which is itself composed of three separable elements: a base 3, a frame 4 and a support adapter 5; the base 3 and the frame 4 together form a platform.

Figure 2:
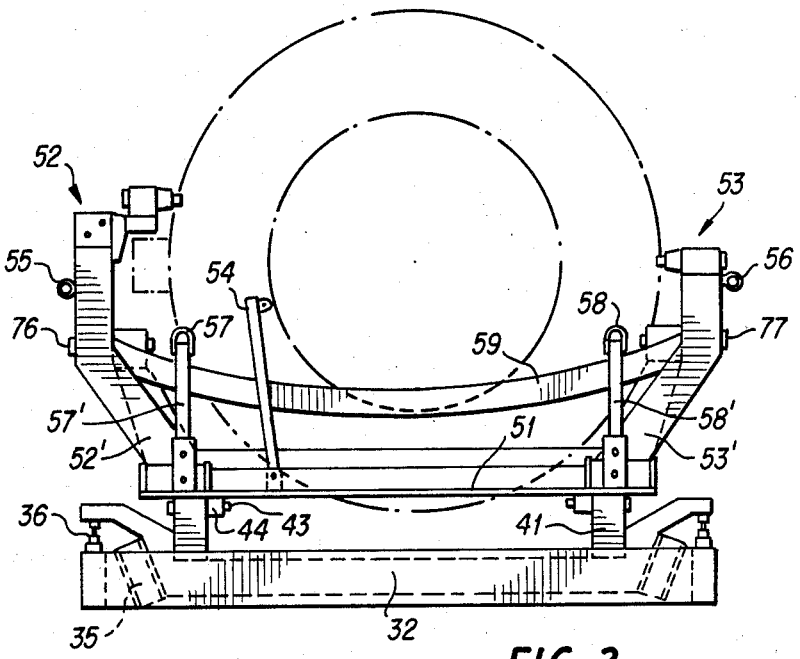
FIG. 2 shows the same framework as in FIG. 1 seen from the right-hand end when considering FIG. 1.
Figure 3:
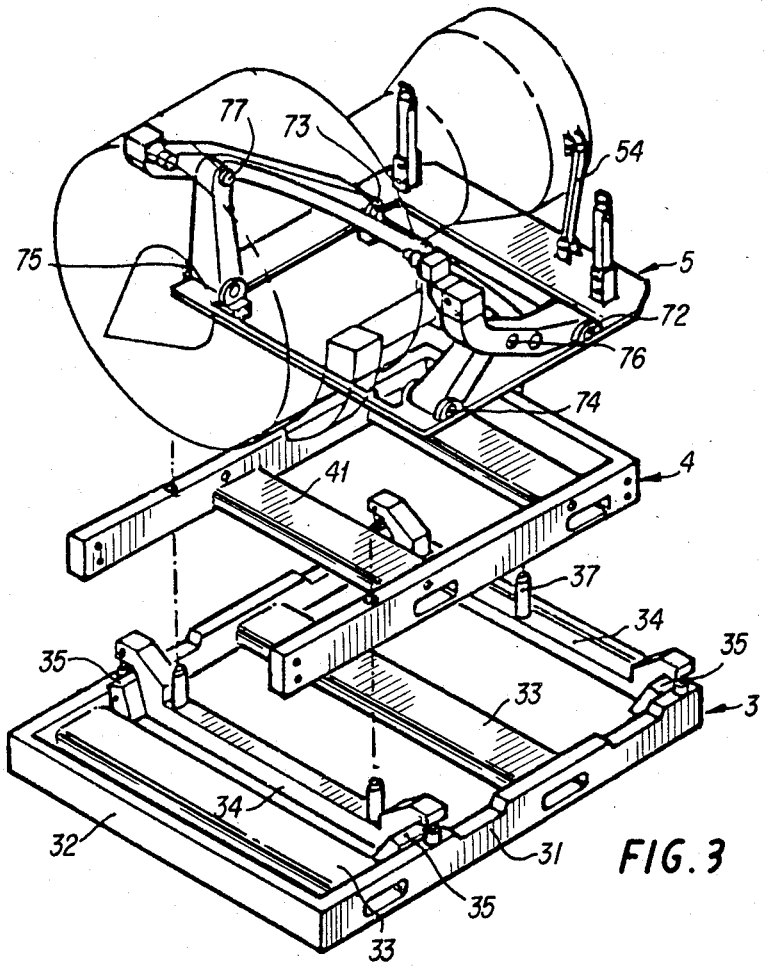
FIG. 3 is an exploded perspective view of the framework of FIGS. 1 and 2.

The base 3 comprises a chassis constituted by two longitudinal members 31 interconnected by two beams or cross-members 32, the two longitudinal members also being interconnected by two tunnel members 33 intended to receive the forks of a fork-lift truck. This chassis supports the frame 4 through the intermediary of two transverse members 34 which are secured to the longitudinal members 31 with the incorporation of resilient suspensions 35 in order to isolate the assembly of frame-adapter-engine from shocks or vibrations received by the base 3 during a road transportation operation, for example. Each of the elements of the suspension can be constituted by an elastomer block, of parallelepiped rectangular shape, secured between two metallic plates, one rigid with the transverse member, the other with the longitudinal member 31 in question. These blocks, as well as their supports, are inclined with respect to the vertical as will appear clearly in FIG. 2, in order to guard against fracture of the suspension and, to guarantee security on the base of the part suspended in the case of excessive horizontal transverse forces. Mechanical abutments 36, disposed on one and on the other side of each elastomer block, limit the longitudinal and vertical displacements of the suspended part with respect to the base. Other types of resilient suspensions are possible; in place of the elastomer block, it is possible to utilize helically wound metal cables secured to metal cores.

The frame 4 comprises two longitudinal members 41 supported on the transverse members 34 and which are held in position by transverse frame connecting means, for example of the tenon and mortise type. Two tunnel members 42 are likewise provided in order to accommodate the forks of a fork-lift truck. The frame is designed to receive at each of the ends of the longitudinal members 41, roller means not shown; these means enable local displacement at a reduced speed on the assembly of frame-adapter-engine separated from the base 3. A base plate 51 of the support adapter is secured on the frame to the pin means 43 connecting the longitudinal member 41 to bushes 44 rigid with the base plate 51.

The adapter-support comprises, mounted on the base plate 51, three support members 52,53,54 and a four-point hoist device; the latter being constituted by two rings 55 and 56 secured on the members 52 and 53, and two rings 57 and 58 at the ends of two arms 57',58' connected in a detachable manner to the base plate 51.

In the preferred embodiment, the turbo jet engine 1 indicated in chain lines is a turbo jet engine with a high by-pass ratio supported at three points; two points on the fan casing and one point on the exhaust casing. The two members 52 and 53 are provided at their upper ends with connecting means to the fan casing, for example, clamps engaging pins themselves engaged in ball joints located within the casing. The support member 54 is likewise provided at its upper end with connecting means with the exhaust casing. It is connected at its lower end by a pin to a clevis rigid with the base.

The members 52,53 supporting the main part of the weight of the engine, are stoutly dimensioned and, are each constituted by a leg 52',53' reinforced by a strut 52'',53''. The legs 52',53' are interconnected at the base through the intermediary of a pivot 72,73 comprising a pin cooperating with a clevis rigid with the base. The struts are interconnected similarly to the base by a pivot 74,75 comprising a pin cooperating with a clevis rigid with the base. Each strut is secured to the corresponding leg by means of a pin 76,77. The two support members are interconnected by a transverse reinforcing beam 59.

Such a framework is used in the following manner.

On the hypothosis that the engine is to be dispatched from the engine works to that of the aircraft manufacturer, by using road and aerial transport means at least cost and under optimum safety conditions, the engine will be transported on the framework provided, using road routes, where it acts in practice to protect the engine against vibrations and excessive shocks which may otherwise be produced during such transportation. Over the parts of the route using aerial transport means, the base is no longer necessary, its omission enabling the weight to be transported to be reduced. At the aircraft factory once the engine is fully equipped with ancillaries and ready to be installed in the aircraft a roller device is mounted at each of the ends of the longitudinal members 41 of the frame 4 and taken to the assembly beneath the wing of the aircraft in order to slide it to the interior of parts of the cowling rigid with the pylon. The support adapter is uncoupled from the frame by withdrawing the pins 43, which enables hoisting of the engine with the support adapter by means of straps engaged in the rings 55,56,57,58; once the engine is secured to the pylon of the aircraft, the support members are uncoupled from the casing and the adapter lowered onto the frame 4. In order to facilitate disengagement of the frame and of the support adapter, it may be necessary at least partially to withdraw the support members 52 and 53, in order that it will be sufficient to release one of the ends of the struts 52'',53'' enabling the legs 52'53' to pivot about their pivot assembly on the base plate 51. Similarly the support member 54 is returned to the base plate as well as the arms 57',58' of the hoist device.

If it is desired to lower the engine, it will readily be understood that it is sufficient to effect the operations in the reverse order.

After use, the frameworks are returned to the engine manufacturer, either the adapter-support frame assembly only, or this assembly plus the base 3. Everything depends on the organization of the transport chain of the engines between the engine manufacturer and the aircraft manufacturer. In order to facilitate their transportation when empty, the frameworks are stacked one on the other after having folded the support members on to the base plate 51; by releasing one of the two pins of each strut 52'',53'' it is possible to enable them as well as the legs 52',53' to be located along the base plate 51. At the same time the third support member 54 is lowered together with the arms of the hoist device 57',58'.

Figure 4:
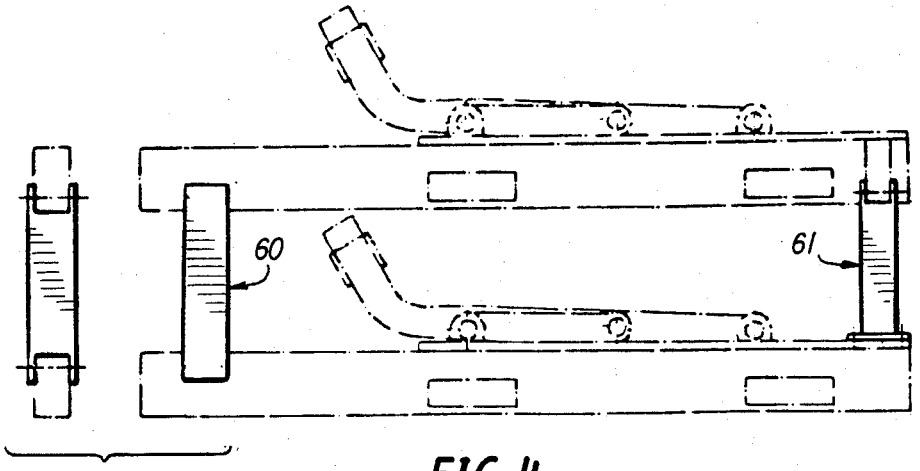
FIG. 4 illustrates two folded, stacked frameworks in accordance with the invention.

FIG. 4 shows how it is possible to stack two frameworks, or more, by using the front support mounting 60 and the rear support mounting 61 which are secured by any appropriate means, bolts for example, to the frame of the two superposed frameworks.

In a simplified modification, it is possible to design a monoblock framework; in this modification the parts of the main base 3, the frame 4, are no longer separable, they are secured together as a common element forming a platform on which the support members 52,53 and 54 are pivoted with possible incorporation of resilient suspensions. In spite of the fact that it will not be possible to install the engine on the pylon of the aircraft from the framework, since the assembly is then too heavy in order to be hoisted from the wing of the aircraft, such a modification has the advantage of a reduced number of parts facilitating their administration and the modification may be preferred, depending upon the projected use.

I claim:

1. In a transportation framework for a turbo machine, a mobile platform, three support members for supporting the turbo machine at three points and on which the turbo machine rests during transportation and handling operations, and means for adjusting the location of the said support members with respect to the said platform so as to enable said support members to assume at least two locations, one location being an active support location for the turbo machine and the other location being an inactive location where the support members are folded onto the platform.

2. A framework according to claim 1 comprising a pivot assembly connecting the support members to the platform, the pivot axis being horizontal.

3. A framework according to claim 1 comprising a resilient suspension incorporated between the support members and the bottom of the platform.

4. A framework according to claim 1 wherein at least one of the support members is constituted by a leg, and the framework further comprises means at one end of the leg for attachment to a turbo machine, means at the other end of the leg for pivoting on the platform and, a strut detachably connected at one end to the platform and at the other end to the leg.

5. A framework according to claim 1 comprising support means enabling stacking of at least two frameworks the one on the other when the support members are in the inactive location.

6. A framework according to claim 5 wherein the support means are constituted by mountings connected rigidly to the platforms of the two frameworks disposed the one on the other.

7. A framework according to claim 1 wherein the platform is constituted by at least two separable elements comprising:

a base and a frame, the base being supported through the intermediary of a resilient suspension of the frame rigid with the support members.

8. A framework according to claim 7 wherein the support members are mounted pivotally on a base plate detachably supported on the frame.

9. A transportation framework for a turbo-machine comprising a base member having two parallel longitudinal members, two parallel cross members and two hollow transverse members extending between the longitudinal members intermediate the ends thereof and facilitating engagement by the forks of a fork-lift truck, a frame member, resilient means supporting the frame member on the base member, and three-point mounting means on the frame member, said mounting means including, support members for the turbo-machine pivotally mounting with respect to the frame member, and strut members arranged to reinforce two of the support members when pivoted to lie at an angle to the frame member.

* * * * *